US009261293B2

(12) United States Patent
Peteri

(10) Patent No.: US 9,261,293 B2
(45) Date of Patent: Feb. 16, 2016

(54) APPARATUS FOR DISPENSING HOT OR BOILING WATER

(75) Inventor: Niels Theodoor Peteri, Rotterdam (NL)

(73) Assignee: HENRI PETERI BEHEER B.V., Ridderkerk (NL)

( * ) Notice: Subject to any disclaimer, the term of this patent is extended or adjusted under 35 U.S.C. 154(b) by 997 days.

(21) Appl. No.: 13/497,785

(22) PCT Filed: Sep. 27, 2010

(86) PCT No.: PCT/NL2010/050627

§ 371 (c)(1),
(2), (4) Date: Aug. 10, 2012

(87) PCT Pub. No.: WO2011/037466

PCT Pub. Date: Mar. 31, 2011

(65) Prior Publication Data

US 2012/0305104 A1 Dec. 6, 2012

(30) Foreign Application Priority Data

Sep. 25, 2009 (NL) ..... 2003556

(51) Int. Cl.
*F16K 49/00* (2006.01)
*F24H 9/12* (2006.01)
*E03C 1/04* (2006.01)

(52) U.S. Cl.
CPC ..... *F24H 9/126* (2013.01); *E03C 1/0411* (2013.01); *Y10T 137/6416* (2015.04)

(58) Field of Classification Search
CPC ..... F24H 9/126; F24H 1/20; E03C 1/0411; Y10T 137/6606; B64D 11/04
USPC ..... 137/341; 222/146.5, 146.2; 251/129.01; 4/678
See application file for complete search history.

(56) References Cited

U.S. PATENT DOCUMENTS

2005/0109763 A1* 5/2005 Lee ..... B64D 11/02 219/483
2007/0044736 A1 3/2007 DeSantis et al.

FOREIGN PATENT DOCUMENTS

CN 101248315 8/2008
CN 201121975 9/2008

(Continued)

OTHER PUBLICATIONS

Search Report issued for Chinese Patent Application No. CN 2010800536396, dated Jan. 7, 2014, 2 pages.

(Continued)

*Primary Examiner* — Kevin Lee
*Assistant Examiner* — P. Macade Nichols
(74) *Attorney, Agent, or Firm* — Morrison & Foerster LLP

(57) ABSTRACT

An apparatus for dispensing hot or boiling water which is provided with a thermally insulated reservoir which is resistant to an excess pressure prevailing in the interior, an electric heating element which is arranged in the reservoir, a discharge conduit and a valve which is included in a fluid communication between the reservoir and the discharge conduit and provided with a valve seat and a movably arranged valve member which in a closed position is pressed with a closing force against the valve seat and which can be brought with an operating element to an opened position, wherein the configuration of the valve and the connection thereof to the fluid communication are such that an excess pressure prevailing in the reservoir exerts a force on the valve body which is directed opposite to the closing force, wherein the closing force is such that the valve member is pressed from the closed position when an excess pressure prevailing in the reservoir reaches a threshold value.

22 Claims, 3 Drawing Sheets

(56) References Cited

FOREIGN PATENT DOCUMENTS

| | | |
|---|---|---|
| DE | 10 2007 051 433 | 4/2009 |
| EP | 0 467 480 | 1/1992 |
| EP | 1 000 575 | 5/2000 |
| GB | 1 373 990 | 11/1974 |
| GB | 2 454 065 | 4/2009 |
| WO | WO-2004/038305 | 5/2004 |

OTHER PUBLICATIONS

International Search Report for PCT/NL2010/050627, mailed Sep. 16, 2011, 3 pages.

* cited by examiner

APPARATUS FOR DISPENSING HOT OR BOILING WATER

Cross-Reference to Related Applications

This application is the national phase of PCT application PCT/NL2010/050627 having an international filing date of 27 Sep. 2010, which claims benefit of Netherlandic patent application No. 2003556 filed 25 Sep. 2009. The contents of the above patent applications are incorporated by reference herein in their entirety.

FIELD OF THE INVENTION

The invention relates to an apparatus for dispensing hot or boiling water.

BACKGROUND

Such an apparatus was first described in NL-A-7112368, whose British equivalent has number GB-A-1373990. A further development of this apparatus is described in EP-B-0 467 480. The apparatus described in that specification is provided with a thermally insulated reservoir which is resistant to an excess pressure prevailing in the interior of the reservoir. The reservoir is provided with a supply conduit adjacent an underside of the reservoir which is designed for connection to the public water supply system, while in use, cold tap water is supplied from the public water supply system via the supply conduit to the reservoir, as soon as hot or boiling water is discharged from the reservoir. The reservoir further has a discharge conduit adjacent a top side of the reservoir via which discharge conduit, in use, hot or boiling water can be discharged from the reservoir. In the reservoir, an electric heating element is included. An outflow pipe is connected via a fluid communication to the discharge conduit. Further, a valve is provided. As stated in the specification, the valve can be provided with a spring biased valve member so that in case of an emergency, it can serve as a safety provision. How such a valve could be designed is not described in this specification. Neither is it described what type of emergency is intended. Independently of the foregoing, it is stated in the specification that the valve can be electrically operated. How this could be realized is not described in the specification either.

In practice, such an apparatus for dispensing boiling water is not put on the market with an electrically operable valve, and also it proves not to be simple to provide a reliable apparatus that keeps functioning in a reliable manner under the difficult conditions of dispensing boiling water.

The apparatuses of the firm of Peteri B.V which are put on the market under the brand name Quooker® are provided with a manually operated valve, more particularly a valve which is operated as a conventional tap water tap provided with a turning knob, albeit that it is provided with a safety provision. The safety provision entails that in order to be turned and hence opened, the turning knob is to be pressed-in against the spring bias. In this manner it is envisaged that the valve designed as tap can only be opened through a deliberate operation, i.e. simultaneously pressing-in and turning the turning knob of the tap. This safety provision is also described in EP0792970. With the Quookers sold in practice, an excess pressure safety provision of the reservoirs is provided on the so-called inlet combination. The inlet combination is an assembly of a number of connecting couplings and valves located upstream of the inlet of the reservoir. In the event of an excess pressure above a particular value in the reservoir, the pressure in the reservoir is reduced via the inlet combination. Steam may then be released into the sink cupboard.

SUMMARY OF THE INVENTION

An apparatus is envisaged for dispensing hot or boiling water, which has an electric operation with a minimum of parts and which provides a durable and reliable protection against too high an excess pressure in the interior of the reservoir.

According to a first aspect of the invention, an apparatus for dispensing hot or boiling water is provided with:

- a thermally insulated reservoir which is resistant to an excess pressure prevailing in the interior of the reservoir, the reservoir being provided with:
  - a supply conduit adjacent an underside of the reservoir which is designed for connection to the public water supply system, while, in use, cold tap water is supplied via the supply conduit from the public water supply system to the reservoir as soon as hot or boiling water is discharged from the reservoir; and
  - a discharge conduit adjacent a top side of the reservoir via which discharge conduit, in use, hot or boiling water can be discharged from the reservoir;
- an electric heating element which is disposed in the reservoir;
- an outflow pipe which is connected via a fluid communication to the discharge conduit;
- a valve which is included in the fluid communication, the valve being provided with;
  - a valve body;
  - an inlet which is connected to an upstream part of the fluid communication;
  - an outlet which is connected to a downstream part of the fluid communication;
  - a valve seat; and
  - a movably arranged valve member which in a closed position is pressed against the valve seat with a closing force;
  - an actuator which in an operated condition exerts a lifting force on the valve member directed opposite to the closing force such that the valve member is lifted from the valve seat;
  - an interior fluid communication in the valve body which connects the inlet to the outlet and which is sealable by the valve member;

wherein the configuration of the valve and the connection thereof to the fluid communication are such that an excess pressure prevailing in the reservoir exerts a force on the valve member which is directed opposite to the closing force, while the closing force is such that the valve member is pressed from the closed position when an excess pressure prevailing in the reservoir reaches a threshold value; and

- an operating element for bringing the actuator in an operated condition and in a non-operated condition for the purpose of bringing the valve member in an opened and the closed position, respectively.

As the valve member is used both for opening the valve in a regular manner when a user is in need of boiling water, and allows for opening of the valve against the action of the closing force in a situation of too high an excess pressure in the reservoir given a particular threshold value, an excess pressure safety provision is provided which is put in motion on a very regular basis. Especially with boiling water, this is an important aspect as boiling water leads to lime scale deposit. Excess pressure safety provisions which are in contact with boiling water and which are not regularly moved run the risk of getting jammed through lime scale deposit, so that they are no longer effective in conditions where it counts, i.e. with an excess pressure prevailing in the reservoir that exceeds a particular threshold value. In hydraulic systems where valves such as, for instance, electromagnetic valves, are used, normally, these valves are included in a pipe system such that, conversely, the pressure that prevails in the upstream pipe part of the electromagnetic valve presses the valve in a closed position. By contrast, with the apparatus according to the present invention, this valve is connected such that the pressure in the upstream pipe part is directed opposite to the dosing force, so that the respective pressure tends to open the valve. It is only owing to the presence of the closing force that in normal conditions the valve remains closed. When a particular threshold value of the excess pressure in the reservoir is exceeded, the valve member is pressed from the closed position. Therefore, the electromagnetic valve has both a function of use, in the sense that with the valve the user controls the dispensing of boiling water, and a function of safety in the sense that with the very same valve, more particularly the same valve body, also an excess pressure safety provision is provided. Therefore, with a minimum of parts, both the operation and an excess pressure safety provision can be realised. An additional advantage is that in case of excess pressure, no steam or water ends up in the sink cupboard in which the apparatus is arranged, but the steam and the water are discharged via the outlet pipe to the sink. As a result, the release of vapour in the sink cupboard is prevented. Since for normal use as well as for the excess pressure safety provision the same valve body is used which is therefore opened and closed on a regular basis, i.e. with each use, the safety provision is reliable and durable.

In one embodiment, the valve can be an electromagnetic valve wherein the movably arranged valve member is provided with ferromagnetic material, wherein the actuator of the valve is an electric coil which surrounds the ferromagnetic material of the valve member at least partly and which in an operated condition exerts a lifting force on the valve body directed opposite to the closing force such that the valve member is lifted from the valve seat.

In an alternative embodiment, the actuator of the valve can be an electric motor, of which a shaft is connected to the valve member with clearance such that when an excess pressure above the threshold value mentioned prevails in the reservoir, owing to the prevailing pressure and by virtue of the available clearance, the valve member can be pressed from the valve seat in a non-operated condition of the electric motor, and wherein in an operated condition of the electric motor, the shaft is brought in a position in which the valve member is lifted from the valve seat against the closing force.

In one embodiment, the threshold value can be in a range of 2-11 bar. In order to prevent the water in the reservoir, which is held at a superatmospheric pressure, from boiling, a superatmospheric pressure must prevail in the reservoir. However, this pressure should not run up too high. When the pressure reaches the threshold value mentioned, the valve member will be opened against the closing force. The range mentioned involves excess pressure compared to the atmospheric pressure. Therefore, in absolute pressure approximately 1 bar is to be added to the numeric value range mentioned.

In one embodiment, the closing force which is exerted on the valve member can be realized by a spring under a bias. Such an embodiment has the advantage that without consumption of electric energy, the closing force can be provided. In an alternative embodiment, the closing force could also be supplied by the electric coil or electric motor. However, this would lead to a continuous energy consumption and is therefore not preferred.

With the marketed Quooker the sealing valve comprises two ceramic plates which are each provided with an opening and which are arranged to be rotatable relative to each other for opening and closing the valve. Such ceramic plates are heat resistant and therefore eminently suitable for use in an apparatus for dispensing boiling water. Therefore, with such an embodiment of the valve, there is no valve member that is pressed with a particular closing force against a valve seat. With a valve provided with a valve member which is pressed against a valve seat, in order to obtain a proper sealing, the part of the valve member abutting against the valve seat should preferably be manufactured from somewhat flexible material. However, in general, flexible material is less well resistant to long-term exposure to the high temperature of boiling water. In order to solve this problem, an embodiment of the present invention provides an apparatus with which the upstream part of the fluid communication comprises a pipe which is connected by an upstream end to the discharge conduit of the reservoir and which is connected by a downstream end to the inlet of the valve, while the pipe traverses a path with, successively, viewed from the upstream end to the downstream end, an upwardly extending part, a top and a downwardly extending part.

Due to the fact that cold water is heavier than hot water, in the downwardly extending part of the pipe water which cools down will collect. Hot water, which, as a result of convection, tends to rise up from the reservoir will therefore rise to the top of the pipe but at that location cannot flow further into the pipe. Thus, boiling water can be prevented from being in continuous contact with the valve, more particularly, the valve member and the valve seat thereof. The valve member part, generally designed to be flexible, which abuts against the valve seat is therefore each time in contact with boiling water only for a very brief time and for the larger part of the remaining time is in contact with water at a much lower temperature. This has a particularly favourable effect on the durability of the valve. Furthermore, as a result of this design of the supply conduit, the heat transfer to the valve body of the valve will be considerably limited. Therefore, via the valve body, only a minimum amount of heat can be given off to the surroundings.

In order to reduce heat transport to the valve even further, in one embodiment, the pipe can comprise a plastic tube part. Plastic is a poor heat conductor and therefore minimal heat transfer to the valve body will take place via the pipe too. An even greater improvement of the energy yield of the apparatus can be obtained when furthermore the valve body is manufactured from stainless steel. Stainless steel is a particularly poor heat conductor and insofar as there still is contact with hot water, this involves only one end of the valve member, and heating of the rest of the valve member and transfer of heat to the surroundings will only take place to a very limited extent.

Further elaborations of the invention are described in the subdaims and will be further elucidated in the following on the basis of an exemplary embodiment with reference to the drawings.

DETAILED DESCRIPTION

Figure 1:
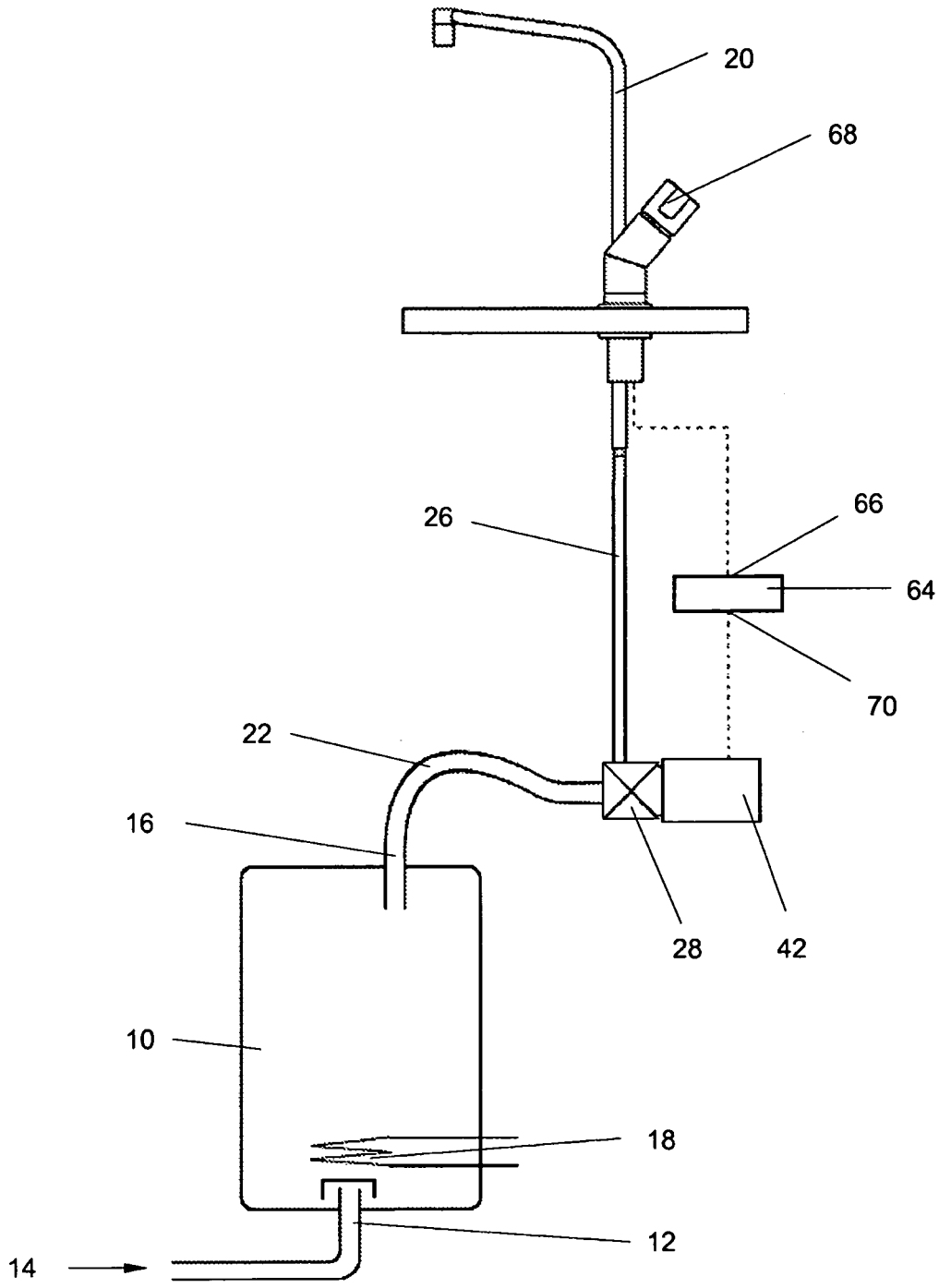
FIG. 1 shows a schematic side-view of an exemplary embodiment of the apparatus.

The exemplary embodiments schematically shown in the Figures serve only as example and serve only for further elucidation. The exemplary embodiment comprises a thermally insulated reservoir 10 which is resistant to an excess pressure prevailing in the interior of the reservoir 10. The reservoir 10 is provided with a supply conduit 12 adjacent an underside of the reservoir 10. The supply conduit 12 is designed for connection to the public water supply system 14. In use, cold tap water is supplied via the supply conduit 12 from the public water supply system to the reservoir 10 as soon as hot or boiling water is discharged from the reservoir 10. The reservoir 10 is further provided with a discharge conduit 16 adjacent a top side of the reservoir 10. Via the discharge conduit 16, in use, hot or boiling water can be discharged from the reservoir 10. In the reservoir 10, an electric heating element 18 is arranged. Through a suitable control of the electric heating element 18, the temperature of the water in the reservoir 10 can be brought and held above the atmospheric boiling point. The apparatus is further provided with an outlet pipe 20 which is connected via a fluid communication 22, 24, 26 to the discharge conduit 16 of the reservoir 10. In general, the outlet pipe will have an outflow end which is located above a sink or similar drain. Preferably, the outlet pipe 29 is pivotable and height adjustable. Thus, pans and cups of different heights can be filled while they stand on the counter or in the sink without boiling water being spilled. The apparatus further comprises a valve 28, 28' which is included in the fluid communication 22, 24, 26.

The valve 28, 28' is provided with a valve body 30, 32, 30', 32'. The valve 28, 28', more particularly the valve body 30, 32, 30', 32' thereof is provided with an inlet 34, 34' which is connected to an upstream part 22 of the fluid communication. An outlet 36, 36' of the valve 28, 28' is connected to a downstream part 26 of the fluid communication. The valve 28, 28' is further provided with a valve seat 38, 38' and a movably arranged valve member 40, 40' which, in a closed position, is pressed with a particular closing force against the valve seat 38, 38'. The valve 28, 28' further comprises an actuator 42, 42' which in an operated condition, i.e. a condition corresponding with an opened tap, exerts a lifting force on the valve member 40, 40' directed opposite to the closing force such that the valve body 40, 40' is lifted from the valve seat 38, 38'. The valve 28, 28' further contains an interior fluid communication 24, 24' which connects the inlet 34, 34' to the outlet 36, 36' and which is sealable by the valve member 40, 40'. The configuration of the valve 28, 28' and the connection thereof to the fluid communication 22, 26 are such that an excess pressure prevailing in the reservoir 10 exerts a force on the valve member 40, 40' which is directed opposite to the closing force. The closing force is such that the valve member 40, 40' is pressed from the closed position when an excess pressure prevailing in the reservoir 10 reaches a threshold value. The apparatus is further provided with an operating element 68 for bringing the actuator 42, 42' in an operated condition and in a non-operated condition for the purpose of bringing the valve body 40, 40' in an opened position and the closed position, respectively.

A thus designed apparatus for dispensing boiling water is reliable and durable in that the same valve body 40, 40' is used both for normal use when dispensing boiling water and for excess pressure protection. The risk of the excess pressure safety provision being no longer effective due to, for instance, lime scale deposit is thus virtually excluded because the same valve member 40, 40' which is to be opened at an excess pressure prevailing in the reservoir 10 exceeding a particular threshold value, is also opened each time with normal use. With the present apparatus, the valve body serving as excess pressure safety provision getting stuck due to non-use thereof and optional lime scale formation or the like are therefore prevented. Another advantage is that with an excess pressure prevailing in the reservoir above a particular threshold value, the steam/and or the water in the excess pressure situation is dispensed via the outlet pipe to the surroundings. Therefore, in general, the water will end up in a sink or a similar drain and no steam is released into the sink cupboard in which the reservoir 10 is normally disposed. Yet another advantage is that there is only one moving part, i.e. the valve member 40, 40'. As a result, the apparatus can be manufactured in an economical manner and furthermore, the only one moving part is beneficial to a reliable operation.

The threshold value mentioned at which the valve body 40, 40' is lifted from the valve seat 38, 38' against the closing force as a result of excess pressure prevailing in the reservoir 10 can be in the range of, for instance, 2-11 bar. In other words, an absolute pressure in the range of 3-12 bar. With a threshold value lying in this range it is effected that water present in the reservoir 10 can be kept at a superatmospheric pressure so that the temperature thereof can be held above the atmospheric boiling point without the water in the reservoir starting to boil. When the user wishes to draw boiling water, he operates the valve 28, 28' with the operating element 68, so that the actuator 42, 42' is operated, i.e. activated, and the valve body 40, 40' is lifted from the valve seat 38, 38'. The outflowing water will start to boil while flowing out as a result of the fact that it is exposed to the atmospheric pressure instead of to an excess pressure.

Figure 2:
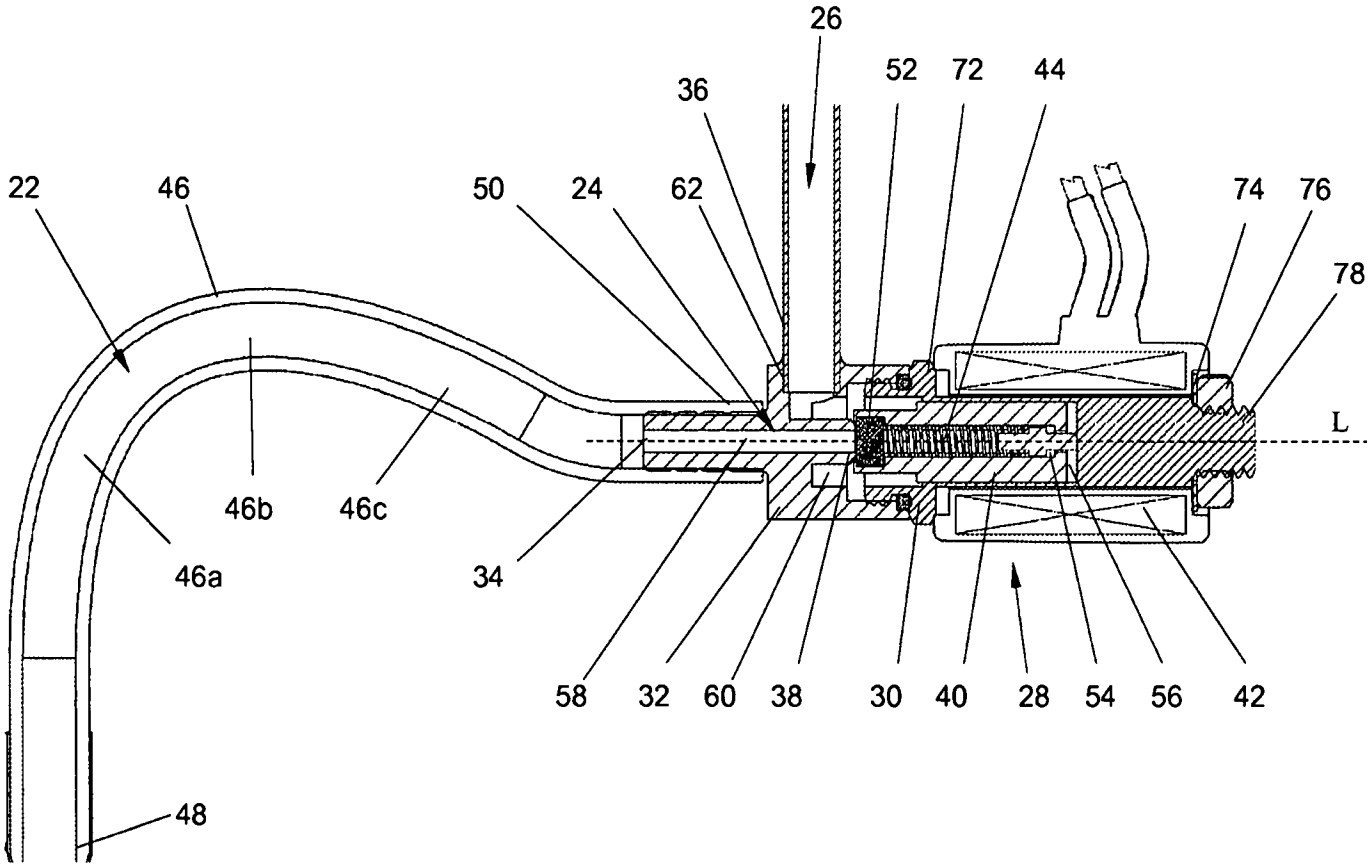
FIG. 2 shows a schematic cross sectional view of a valve of the electromagnetic type with pipes connected thereto.

Presently, an electromagnetic design of the valve 28 will be described in further detail with reference to FIG. 2. In one embodiment, of which an example is shown in FIG. 2, the valve member 40 may be designed as a plunger having on an end thereof a sealing member 52 of flexible material. In a closed position of the valve member 40, the sealing member 52 abuts against the valve seat 38. The flexible material provides a reliable seal of the fluid communication 24 in the electromagnetic valve 28. In one embodiment of the electromagnetic valve 28, the closing force can be generated by a spring 44 under a bias. An example of this embodiment is shown in FIG. 2. For forming a compact, electromagnetic valve, it is favourable when the plunger is designed to be hollow for forming a spring chamber 54 in which the spring 44 can be included. Here, the spring 44 abuts by one end against an interior wall of the plunger which bounds the spring chamber 54 and, via a coupling spindle projecting through the plunger, bears by a second end on a part of the valve body 30, 32. With the valve member 40 in closed position, the distance between the interior wall of the plunger against which the first end of the spring abuts and the part of the valve body 30, 32 on which the second end of the spring 44 bears is a given. With this given, the dimensioning of the spring 44 determines the threshold value at which the excess pressure prevailing in the reservoir 10 lifts the valve member 40 from the valve seat 38. In one embodiment, with the exception of the sealing member 52, the plunger-shaped valve member 40 can be made completely from ferromagnetic material. However, it is also possible that the plunger is formed partly from a different material and comprises, for instance, a ferromagnetic jacket.

In one embodiment, the valve body 30, 32 can be provided with a coil body part 30 with a valve member chamber 56 which is surrounded by the electric coil 42. The valve body 30, 32 can further comprise a connecting body part 32 containing the inlet 34 and the outlet 36 as well as the valve seat 38. Here, the connecting boy part 32 is couplable to the coil body part 30, for instance by means of screw thread or by means of a bayonet coupling. By thus constructing the valve body from two body parts, manufacture thereof is relatively simple. In the exemplary embodiment shown, the electric coil 42 is attached on the coil body part 30 in that it is clamped between a shoulder 72 on the coil body part 30 and a clamping ring 74 which is pressed against the coil with the aid of a nut 76. The nut 76 engages a screw thread part 78 provided on the coil body part 30.

Figure 3:
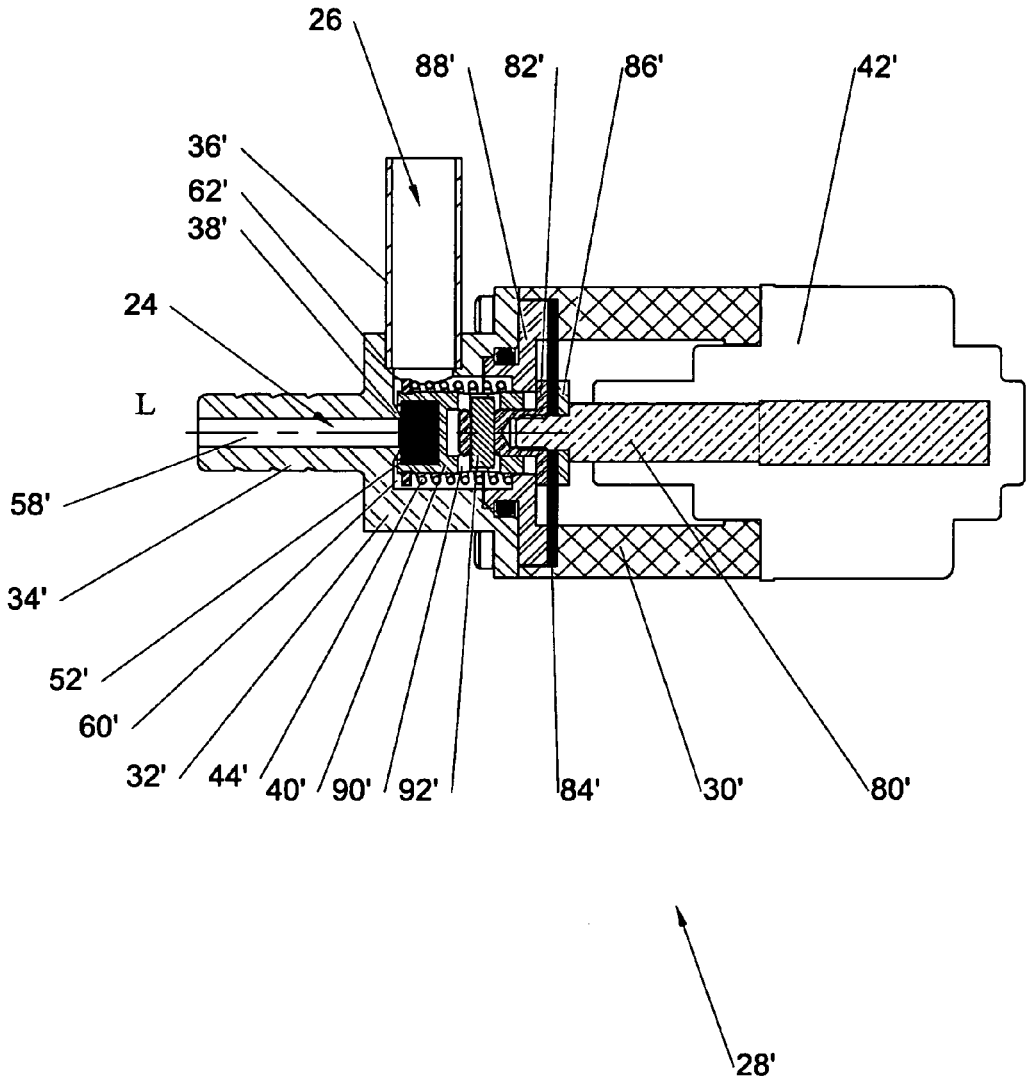
FIG. 3 shows a schematic cross-sectional view of a valve operated by an electric motor.

FIG. 3 shows an exemplary alternative embodiment of the valve 28'. In this embodiment, the actuator 42' of the valve is designed as an electric motor 42'. The electric motor 42' can, for instance, be a stepping motor or a servo motor provided with a rotor and a stator (not shown). In the example shown, electric motor 42' is provided with an integrated transmission (not shown) which converts rotation of the rotor to an axial movement of a shaft 80' of the motor 42'. The shaft 80' is connected to the valve member 40' with clearance such that, with an excess pressure prevailing in the reservoir 10 above the threshold value mentioned, owing to the prevailing excess pressure and owing to the clearance available between the plunger 40' and shaft 80', the valve member 40' can be pressed from the valve seat 38' with the electric motor 42' in a non-operated condition. With the electric motor 42' in an operated condition, the shaft 80' can be brought in a position in which the valve member 40' is lifted from the valve seat 38' against the closing force. With the exemplary embodiment shown of FIG. 3, the position of the shaft 80' is a position retracted in axial direction. Just like with the exemplary embodiment shown in FIG. 2, the valve member 40' may be designed as a plunger with, on the front end thereof, a sealing body 52' of flexible material. With the valve member 40' in closed position, the sealing body 52' abuts against the valve seat 38'. The flexible material provides a reliable seal of the fluid communication 24' in the valve 28'. With this embodiment too, the closing force that is exerted on the valve member 40' can be generated by a spring 44 which is under a bias.

In one embodiment, of which an example is shown in FIG. 3, the valve body 30', 32' can be provided with an electric motor suspension part 30' and a connecting body part 32' which contains the inlet 34' and the outlet 36' as well as the valve seat 38'. The connecting body part 32' is coupled to the electric motor suspension part 30.

For both embodiments, of which examples are shown in FIG. 2 and FIG. 3, respectively, it holds that the connecting body part 32, 32' can be provided with a central bore 58, 58' with a first end forming the inlet 34, 34' and a second end which is surrounded by the valve seat 38, 38'. The connecting body part 32, 32' is further provided with a connecting chamber 60, 60' in which the central bore 58, 58' terminates by the second end and in which the valve seat 38, 38' is located and in which the valve body 40, 40' in closed position extends at least partly. The connecting body part 32, 32' is further provided with a second bore 62, 62' which extends substantially perpendicularly to the central bore 58, 58' and which has a first end that forms the outlet 36, 36' and a second end which terminates in the connecting chamber 60, 60'. For such an embodiment it holds that especially when the actuator is designed as electromagnetic coil 42, the valve 28 has only one moving part and is therefore relatively simple to construct, which greatly enhances the reliability and the durability of the valve 28.

According to a further elaboration, of which an example is shown both in FIG. 2 and in FIG. 3, the valve member 40, 40' designed as plunger has a central longitudinal axis L along which the plunger is movably arranged and the valve seat 38, 38' extends in a plane which is perpendicular to the central longitudinal axis L. With this configuration, excess pressure 10 prevailing in the reservoir 10 exerts a force on the plunger which force is directed opposite to the closing force exerted by the spring 44, 44'. The central bore 58 can have a central longitudinal axis which coincides with the central longitudinal axis L along which the valve body 40, 40', designed as plunger, is movably arranged.

The embodiment of the valve 28' with the electric motor 42', of which an example is shown in FIG. 3, can be provided with a coupling part 82' which connects the shaft 80' of the electric motor 42' and the valve body 40' designed as plunger. Further, a membrane 84' with a central opening can be provided. Through the central opening reaches the shaft 80' of the electric motor 42'. The membrane 84' is watertight and is damped in between the coupling part 82' and a ring or flange 86' which is attached to the shaft 80' of the electric motor 42'. The membrane 84' is provided with an outside circumference which is watertightly connected to the electric motor suspension part 30'. Further, a sealing lid 88' is provided which, together with the membrane 84', is clamped between the connecting body 32' and the electric motor suspension part 30', and which forms a watertight seal between the connecting body 32' and the electric motor suspension part 30'. Further, a spring 44' under a bias is provided which is located in the connecting chamber 60'. The spring 44' abuts by a first end against a retaining ring which is attached in the plunger and abuts by a second end against the sealing lid 88'. In one embodiment, of which an example is shown in FIG. 3, the valve member 40' designed as plunger can be provided with a slotted hole 90' which extends perpendicularly to the plunger central axis L. The coupling part 82' can be provided with a transverse pin 92' which extends perpendicularly to the plunger central axis L and which is included in the slotted hole 90'. The diameter of the transverse pin 92' and the dimensions of the slotted hole 90 are geared to each other such that the clearance mentioned is provided. It will be clear that many alternative constructions for a slotted hole/transverse pin connection are possible for providing an axial clearance between the shaft 80' and valve member 40'.

In one embodiment, of which an example is shown in FIG. 1, the upstream part 22 of the fluid communication 22, 24, 26 can comprise a pipe 46 which is connected by an upstream end 48 to the discharge conduit 16 of the reservoir 10. A downstream end 50 of the pipe 46 is connected to the inlet 34, 34' of the valve 28, 28'. Here, the pipe 46 can traverse a path with, successively, viewed from the upstream end 48 to the downstream end 50, an upwardly extending part 46*a*, a top 46*b* and a downwardly extending part 46*c*. As a result of such a configuration of the upstream part 22 of the fluid communication, boiling water will be prevented from being continuously fed to the valve 28 as a result of convection. The fact is that cold water is heavier than hot water and as a result thereof the hot water will not flow through convection into the downward part 46*c* but be stopped there by relatively cold water. An important advantage of this is that the valve 28 and more particularly the sealing member 52, 52' of flexible material are not continuously in contact with boiling hot water, which will enhance the durability of the electromagnetic valve 28, 28' considerably. Only when the valve is opened for the purpose of use, the sealing member 52, 52' is in contact with boiling hot water for some time. After closing of the valve 28, 28', the water present in the downwardly extending part 46 will cool down and no longer warms up as a result of convection flows. Preferably, the volume which is enclosed by the downwardly extending part 46*c* is small compared to the volume of, for instance, a teacup. The volume of the fluid path that is bounded by the downwardly extending part 46*c* is for instance preferably not greater than 5 millilitres, so that a user is not aware that his cup is initially filled with water which is at a temperature below the atmospheric boiling point. This can be effected by giving the downwardly extending part only a limited length, for instance a length of approximately 5 centimetres with an interior diameter of approximately 3-10 mm. In order to also limit heat losses for as much as possible, with one embodiment of the apparatus, the pipe 46 can comprise a plastic tube part. Plastic is a poor conductor and thus, heat transfer via the pipe 46 will be limited to a minimum. Also, heat transfer via the valve body 30, 32, 30', 32', of the valve 28, 28' can be minimized by manufacturing it from stainless steel. Het path mentioned of the pipe 46 can be created in an efficient manner when the discharge conduit 16 adjacent the top side of the reservoir 10 enables connection of the upstream end 48 of the conduit 46 in vertical direction. Here, it is preferred that the central bore 58, 58' which also defines the inlet 34, 34' of the valve 28, 28' extends substantially horizontally, so that there, the downstream end 50 of the pipe will extend substantially horizontally.

In one exemplary embodiment, the valve 28, 28' can be a two-position valve. In a non-operated condition of the actuator 42, 42', the valve member 40, 40' is in the closed position unless the excess pressure in the reservoir 10 reaches the threshold value. The valve member 40, 40' is in the opened position when the actuator 42, 42' is operated via the operating element 68. Such a valve 28, 28' requires a fairly simple control as the actuator 42, 42' is either in operated or in non-operated condition. The control can for instance be a simple switch that is included in an electric circuit in which a feed is present, for instance the electric mains and the actuator 42 designed as electric coil.

In an alternative embodiment, the valve 28, 28' can be a controllable valve. In a non-operated condition of the actuator 42, 42', the valve member 40, 40' is, normally, in the dosed position unless the pressure in the reservoir 10 reaches the threshold value. The valve member 40, 40' can be brought in a range of opened positions depending on the extent of actuation of the actuator 42 designed as electric coil. A comparable result can be realised by controlling the position of the electric motor 42' when it serves as actuator.

The operation and the control of a controllable valve 28, 28' and hence of the actuator 42, 42' require a somewhat more complicated control. Such a control could be formed, for instance, by a potentiometer included in an electric circuit which is connected to a feed, for instance the electric mains, and in which also the electric coil 42 is present.

However, it is also possible that an electronic control is provided. In one embodiment, such an electronic control 64 can be provided with an input 66 to which the operating element 68 is connected and an output 70 to which is connected, for instance, an actuator designed as electric coil 42 or, alternatively, as electric motor 42. The control 64 can be designed for generating a driving signal which is delivered via the output 70 to the actuator 42, 42', while the driving signal is dependent on the operation of the operating element 68. As already stated, the control can be a simple switch or a potentiometer. The control 64 can be formed by an electronic module which can be provided with control and drive functionality. Further, additional functionality may provide enhanced safety. For instance, when the operating element 68 is touched, the control 64 could generate a warning signal drawing the attention of the user to the fact that the tap dispenses hot or boiling water. Such a signal may be a light signal or a sound signal. Then, the user will either abandon using the tap or will operate the tap deliberately for the purpose of drawing boiling water from the tap.

Although the invention is represented and described in detail with reference to the drawings, these drawings and description should only be considered to be an example. The invention is not limited to the described embodiments. Features which are described in subclaims can be combined with each other. Reference numerals in the claims should not be construed as limitations of the claims but serve merely for clarification.

The invention claimed is:

1. An apparatus for dispensing hot or boiling water, provided with:

a thermally insulated reservoir (10) which is resistant to an excess pressure prevailing in an interior of the reservoir (10), the reservoir (10) being provided with:

a supply conduit (12) adjacent an underside of the reservoir (10) which is configured to connect to a public water supply system (14), while, in use, cold tap water is supplied via the supply conduit (12) from the public water supply system to the reservoir (10) as soon as hot or boiling water is discharged from the reservoir (10); and a discharge conduit (16) adjacent a top side of the reservoir (10) via which discharge conduit (16), in use, hot or boiling water can be discharged from the reservoir (10);

an electric heating element (18) which is disposed in the reservoir (10);

an outflow pipe (20) which is connected via a fluid communication (22, 24, 26) to the discharge conduit (16);

a valve (28, 28') which is included in the fluid communication (22, 24, 26), the valve (28, 28') being provided with;

a valve body (30, 32; 30' 32');

an inlet (34; 34') which is connected to an upstream part (22) of the fluid communication;

an outlet (36) which is connected to a downstream part (26) of the fluid communication (22, 24, 26);

a valve seat (38; 38'); and a movably arranged valve member (40; 40') which in a closed position is pressed with a closing force against the valve seat (38; 38');

an actuator (42; 42') which in an operated condition exerts a lifting force directed opposite to the closing force on the valve member (40; 40') such that the valve member (40, 40') is lifted from the valve seat (38; 38');

an interior fluid communication (24) in the valve body (30, 32; 30' 32') which connects the inlet (34; 34') to the outlet (36; 36') and which is sealable by the valve member (40, 40');

wherein the configuration of the valve (28, 28') and the connection thereof to the fluid communication (22, 26) are such that an excess pressure prevailing in the reservoir (10) exerts a force on the valve member (40; 40') which is directed opposite to the closing force, while the closing force is such that the valve member (40; 40') is pressed from the closed position when an excess pressure prevailing in the reservoir (10) reaches a threshold value; and an operating element (68) for bringing the actuator (42; 42') in an operated condition and in a non-operated condition for the purpose of bringing the valve member (40; 40') in an opened and the closed position, respectively.

2. The apparatus according to claim 1, wherein the valve is an electromagnetic valve (28), wherein the movably arranged valve member (40) is provided with ferromagnetic material, wherein the actuator of the valve (28) is an electric coil (42) which surrounds the ferromagnetic material of the valve member (40) at least partly and which in an operated condition exerts a lifting force on the valve member (40) which is directed opposite to the closing force such that the valve member (40) is lifted from the valve seat (38).

3. The apparatus according to claim 1, wherein the actuator (42') of the valve (28') is an electric motor (42') of which a shaft (80') is connected to the valve member (40') with clearance such that when an excess pressure (10) above said threshold value prevails in the reservoir, owing to the excess pressure and by virtue of the available clearance between valve member (40') and shaft (80'), the valve member (40') can be pressed from the valve seat (38') in a non-operated condition of the electric motor (42'), and wherein in an operated condition of the electric motor (42'), the shaft (80') is brought in a position in which the valve member (40') is lifted from the valve seat (38') against the closing force.

4. The apparatus according to claim 1, wherein the threshold value is in the range of 2-11 bar.

5. The apparatus according to claim 1, wherein the valve comprises a spring (44; 44') under a bias for exerting the closing force on the valve member (40; 40').

6. The apparatus according to claim 1, wherein the upstream part (22) of the fluid communication comprises a pipe (46) which is connected by an upstream end (48) to the discharge conduit (16) of the reservoir (10) and which is connected by a downstream end (50) to the inlet (34; 34') of the valve (28; 28'), wherein the pipe (46) traverses a path with, successively, viewed from the upstream end (48) to the downstream end (50), an upwardly extending part (46*a*), a top (46*b*) and a downwardly extending part (46*c*).

7. The apparatus according to claim 6, wherein the pipe (46) comprises a plastic tube part.

8. The apparatus according to claim 1, wherein the valve body (30, 32; 30, 32') is manufactured from stainless steel.

9. The apparatus according to claim 1, wherein the valve member (40; 40') is a plunger with, at one end thereof, a sealing member (52; 52') of flexible material, which sealing member (52; 52') in a closed position of the valve member (40, 40') abuts against the valve seat (38; 38').

10. The apparatus according to claim 5, wherein a plunger which is hollow forms a spring chamber (54) in which the spring (44) is included, wherein the spring (44) abuts by a first end against an interior wall of the plunger which bounds the spring chamber (54) and abuts by a second end against a part of the valve body (30, 32).

11. The apparatus according to claim 2, wherein the valve body (30, 32) is provided with:

a coil body part (30) with a valve member chamber (56) which is surrounded by the electric coil (42); and a connecting body part (32) containing the inlet (34) and the outlet (36) as well as the valve seat (38); and wherein the connecting body part (32) is coupled to the coil body part (30).

12. The apparatus according to claim 3, wherein the valve body is provided with:

an electric motor suspension part (30); and a connecting body part containing the inlet and the outlet as well as the valve seat; and wherein the connecting body part (32) is coupled to the electric motor suspension part (30).

13. The apparatus according to claim 11, wherein the connecting body part (32) is provided with:

a central bore (58) with a first end forming the inlet (34) and a second end which is surrounded by the valve seat (38);

a connecting chamber (60) in which the central bore (58) terminates by the second end and in which the valve seat (38) is located and in which the valve body (40) in a closed position extends;

a second bore (62) which extends substantially perpendicularly to the central bore (58), with a first end that forms the outlet (36) and a second end which terminates in the connecting chamber (60).

14. The apparatus according to claim 13, wherein the central bore (60) extends substantially horizontally.

15. The apparatus according to claim 9, wherein the plunger has a longitudinal central axis (L) along which the plunger is movably arranged, wherein the valve seat (38) extends in a plane which is perpendicular to the longitudinal central axis (L).

16. The apparatus according to claim 12, provided with:

a coupling part (82') which is connected to the shaft (80') of the electric motor and to the valve member which is a plunger;

a membrane (84') with a central opening through which reaches the shaft (80') of the electric motor (42') and which is watertightly clamped between the coupling part and a ring or flange (86') which is attached to the shaft (80') of the electric motor, wherein the membrane is provided with an outer circumference which is watertightly connected to the electric motor suspension (30'); and a sealing lid (88') which, together with the membrane, is clamped between the connecting body and the electric motor suspension and which forms a watertight seal between the connecting body and the electric motor suspension; and a spring (44') under a bias which is located in a connecting chamber (60') and abuts by a first end against a retaining ring which is attached in the plunger and abuts by a second end against the sealing lid (88').

17. The apparatus according to claim 16, wherein the valve member (40') is provided with a slotted hole (90') which extends perpendicularly to the plunger central axis, wherein the coupling part (82') is provided with a transverse pin (92') which extends perpendicularly to a plunger central axis and is included in the slotted hole, while the diameter of the transverse pin and the dimensions of the slotted hole are geared to each other such that the said clearance is provided.

18. The apparatus according to claim 1, wherein the valve (28) is a two-position valve, wherein in a non-operated condition of the actuator (42), the valve member (40) is normally in the closed position unless the excess pressure in the reservoir (10) reaches the threshold value, and wherein the valve member (40) is in the opened position when the actuator (42) is operated.

19. The apparatus according to claim 1, wherein the valve (28; 28') is a control valve, wherein in a non-operated condition of the actuator (42; 42'), the valve member (40; 40') is normally in the closed position unless the pressure in the reservoir (10) reaches the threshold value and wherein the valve member (40; 40') can be brought in a range of opened positions by controlling the actuator (42).

20. The apparatus according to claim 1, provided with: a control (64) provided with an input (66) to which the operating element (68) is connected and an output (70) to which the actuator (42) is connected, wherein the control (64) is configured to generate a driving signal which is delivered via the output (70) to the actuator (42), wherein the driving signal is dependent on the operation of the operating element (68).

21. The apparatus according to claim 12, wherein the connecting body part (32) is provided with:

a central bore (58) with a first end forming the inlet (34) and a second end which is surrounded by the valve seat (38);

a connecting chamber (60) in which the central bore (58) terminates by the second end and in which the valve seat (38) is located and in which the valve body (40) in a closed position extends;

a second bore (62) which extends substantially perpendicular to the central bore (58), with a first end that forms the outlet (36) and a second end which terminates in the connecting chamber (60).

22. The apparatus according to claim 21, wherein the central bore (60) extends substantially horizontally.

* * * * *